United States Patent [19]

Gaynor

[11] 4,037,068

[45] July 19, 1977

[54] TWO-STAGE ROCKER SWITCH FOR CONTROLLING A FLUORESCENT LAMP CIRCUIT

[76] Inventor: Edwin S. Gaynor, 688 Hulls Farm Road, Southport, Conn. 06490

[21] Appl. No.: 742,704

[22] Filed: Nov. 17, 1976

Related U.S. Application Data

[63] Continuation of Ser. No. 614,168, Sept. 17, 1975, abandoned.

[51] Int. Cl.[2] ..... H01H 21/00; H01H 1/26; H01H 3/20; H01H 23/26

[52] U.S. Cl. ..... 200/5 F; 200/6 BA; 200/6 BB; 200/67 R; 200/153 K; 200/247; 200/284; 200/295; 200/318; 200/339

[58] Field of Search ..... 200/5 F, 6 R, 6 B, 6 BA, 200/6 BB, 6 C, 67 R, 67 D, 67 DA, 67 G, 153 K, 237–251, 283, 284, 293–296, 303, 315, 318, 339

[56] References Cited

U.S. PATENT DOCUMENTS

| | | | |
|---|---|---|---|
| 2,815,501 | 12/1957 | Benson | 200/6 BB X |
| 3,178,522 | 4/1965 | Passarelli, Jr. | 200/6 C |
| 3,221,112 | 11/1965 | Gaynor | 200/5 R |
| 3,371,179 | 2/1968 | Lohr | 200/159 A |
| 3,437,772 | 4/1969 | Piber | 200/284 |
| 3,479,478 | 11/1969 | Robbins | 200/6 R X |
| 3,518,381 | 6/1970 | Gaynor | 200/5 R |
| 3,519,775 | 7/1970 | Weremey | 200/6 BB |
| 3,878,344 | 4/1975 | Lockard | 200/6 B |

*Primary Examiner*—Volodymyr Y. Mayewsky
*Attorney, Agent, or Firm*—Kenyon & Kenyon, Reilly, Carr & Chapin

[57] ABSTRACT

A rocker switch assembly for controlling at least one fluorescent lamp has a contact mounting block fitted in a housing, with a pair of normally closed contacts at one end of the block and at least one pair of normally open contacts at the other end. A rocker button is supported in an opening in the housing above the contacts on the mounting block for limited vertical and pivotal motion against spring biasing forces while being restrained against longitudinal movement. A preferred support means includes stub shafts extending laterally from each side of the rocker button that fit slidably in vertical bearing slots on each side of the opening in the housing. A spring detent catch mounted at the one end of the housing for interfering engagement with a protrusion on the adjacent end of the button provides a positive snap action between a horizontal or neutral "lamp on" button position and a tilted "lamp off" position in which the one end of the rocker button is depressed to open the pair of normally closed contacts. In an oppositely tilted momentary "lamp start" position, the other end of the rocker button is depressed against a biasing means to close each pair of normally open contacts.

10 Claims, 12 Drawing Figures

TWO-STAGE ROCKER SWITCH FOR CONTROLLING A FLUORESCENT LAMP CIRCUIT

This is a continuation of application Ser. No. 614,168 filed Sept. 17, 1975, now abandoned.

BACKGROUND OF THE INVENTION

1. Field of the Invention

The present invention relates to multiple contact electrical switches and particularly to two-stage starter switches for controlling fluorescent lamps.

2. Description of the Prior Art

Fluorescent lamp starter switches normally are of the two-stage type in which separate ON and OFF buttons control a single pole line switch. The ON button, in addition, controls a momentary contact switch, having separate poles for each lamp being controlled by the switch, to complete the heater filament circuits when starting the lamps. U.S. Pat. Nos. 3,221,112 and No. 3,518,381 issued to Edwin G. Gaynor on Nov. 30, 1965 and June 30, 1970, respectively, disclose two switch designs of that general character. Both of these prior designs have a large number of small precision parts and require a correspondingly large number of hand operations for assembly.

The rocker button style of switch has gained increasing popularity in conventional on-off switching applications in recent years and offers the possibility of permitting a switch to have substantially fewer parts than the previous two-button design. A previous attempt by the present inventor to design a rocker button type of fluorescent lamp switch reduced the number of parts by almost one half; however, prototype switches built to that design did not operate reliably.

Reliability over repeated operating cycles numbering in the hundreds of thousands is a principal requirement for switches that are intended to outlast the useful life of the device on which they are installed. In the case of fluorescent lamp switches, it is particularly important that the transition from lamp on to lamp off positions be a positive one; that is, the line contacts should not open too soon before the switch button snaps to the off position. Otherwise, the operator may fail to latch the switch securely off, and the lamps go out but remain connected to the line.

The initial design referred to above employed a rectangular rocker button loosely positioned in a molded plastic switch case above a contact mounting block, with a metal bezel frame cooperating with side flanges on the button to hold it in place. A pair of integrally molded latching fingers extending from the underside of the button at one end were intended to engage pockets molded in a vertical partition of the mounting block when the one end of the button was depressed to the off position.

Under conditions of actual service, however, the line contacts would open well before the latching fingers were locked in the mating grooves. The operator tended to release the button when the lamp went out and the switch would return to the "on" position. In addition, the plastic fingers would take a permanent set after repeated cycles of operation, and the button would not remain locked even when properly latched by the operator. Also, the loosely positioned rocker button could slide longitudinally in the case, and one end would tend to hang up on the edge of the bezel when the other end was depressed.

Another important aspect in the design of this type of two-stage switch is that it should have the proper "feel"; so that even persons unfamiliar with the switch will quickly learn to distinguish the three positions of momentary "start", "on" and "off". The rocker button of the previous design rested on a transverse row of buttons molded in the top of the contact block. These buttons allowed undesirable longitudinal sliding motion while preventing vertical movement against the contact biasing springs. Again, it was discovered in actual service conditions that this design did not provide the proper sensory cues to enable a person to readily distinguish between operating positions.

SUMMARY OF THE INVENTION

It is an object of the present invention to provide an improved two-stage rocker switch assembly that provides positive and reliable switching between momentary contact, intermediate, and lock off positions for repeated cycles of operation over an extended design life.

Another object of the present invention is to provide a two-stage rocker button switch adapted for controlling at least one fluorescent lamp in which the rocker button is supported for limited vertical and pivotal motion against spring biasing forces while being restrained against longitudinal movement.

It is another object of the invention to provide a positive action, reliable, long life rocker button fluorescent lamp switch having substantially fewer parts than previous two-button designs.

Still another object of the invention is to provide a rocker button switch having a spring detent catch mounted on one end of the switch housing for interfering engagement with a protrusion on the adjacent end of the rocker button to provide smooth and positive transition between on and off switch positions.

The foregoing objects are achieved in a rocker switch assembly that includes an open top housing or case, a core or mounting block within the housing for mounting at least one pair of switch contacts, and a rocker button positioned in the open top of the housing above the mounting block.

For convenience in the above and subsequent descriptions of the invention and its preferred embodiment, the switch case will be assumed to be positioned with the rocker button on top and with the opening in the case lying in a horizontal plane. Of course, the switch can be mounted in any position in actual use.

A pair of normally closed switch contacts are located near one end of the core, this pair including a fixed contact positioned in vertically spaced relation above the top of the core at the one end, a movable contact positioned between the fixed contact and the top of the core, and spring-biasing means for urging the movable contact upward toward the fixed contact.

At least one pair of normally open switch contacts may be located near the other end of the core, each pair including a fixed contact on top of the core, a movable contact positioned above the first fixed contact, and spring-biasing means for urging the movable contact upward away from the fixed contact.

The rocker button has a protuberance, preferably in the form of a flange or lip, at the end corresponding to the location of the normally closed contact pair. A metal spring catch is mounted at the adjacent end of the switch case for interfering engagement with the protuberance when that end of the button is depressed. The metal catch and plastic protuberance cooperate to provide smooth positive snap action between a neutral on position of the button and a depressed or tilted off position over repeated operating cycles.

Means are provided for supporting the rocker button for limited pivotal motion about a transverse axis at approximately its midpoint in either direction from the neutral "on" position against the spring force of the first and second movable contact biasing means. The support means at the same time restrains the rocker button against movement parallel to the top of the housing in a direction transverse to the pivot axis. This restraint is an important feature of the present invention in that it results in repeatable positive locking action in cooperation with the metal spring catch at the end of the housing, and it also prevents longitudinal shift with resulting hang up of the end of the button against the inner edge of a conventional mounting bezel.

At the same time the rocker button support means preferably permits limited vertical motion against the spring force of the contact biasing means. This limited vertical motion is another important feature of the invention because it has been found to provide the desirable feel for ensuring proper operation of the switch.

In its preferred embodiment, the rocker switch support means comprises an axle or stub shaft extending from each side of the rocker button and a mating vertical slot extending downward on each side of the top opening of the switch housing. When the button is installed in the housing opening and held in place by any suitable member such as a bezel frame, there is preferably a vertical clearance between each stub shaft and the bottom of its mating slot that provides limited downward pretravel of the button against the contact biasing springs when the button is depressed.

Another feature of the preferred embodiment is a unitized design of each switch contact, spring biasing means, and wiring terminal as portions of a single bent strip of a conductive spring metal. One end of each bent strip serves as a switch contact, the intermediate portions of the movable contact strips function as cantilevered leaf springs, and the other end of each bent strip is arranged as a wedge-type wiring terminal.

The resulting design of a rocker button switch for controlling a dual fluorescent lamp circuit comprises an assembly of only eleven separate parts, of which two of the movable contact members are duplicates, as well as all three of the fixed contact members. The advantages of these and other features of the invention in respect to low cost, simplicity, ease of assembly, and positive reliable operation will be apparent from the figures and the detailed description of the preferred embodiment.

DESCRIPTION OF THE PREFERRED EMBODIMENT

Figure 1:
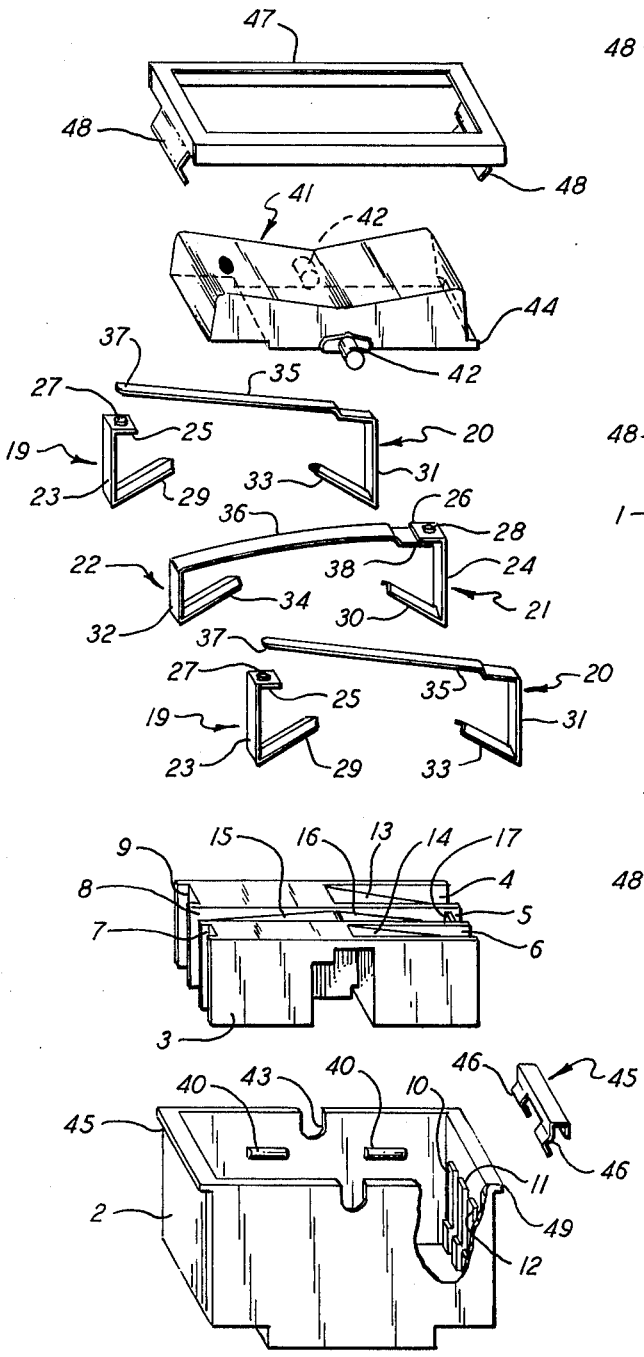
FIG. 1 is an exploded view of all components of the preferred embodiment of the improved switch of the present invention.
Figure 2:
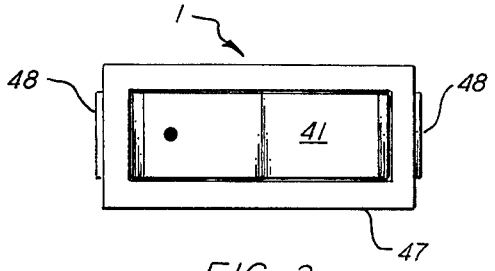
FIGS. 2–5 are top, side, bottom, and end views, respectively, of the assembled switch components of FIG. 1.
Figure 3:
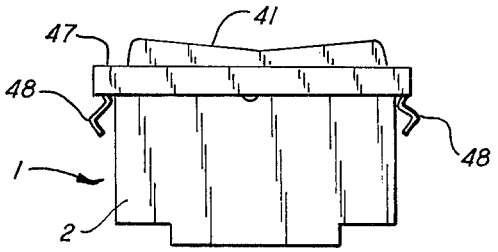

With reference to FIGS. 1 through 5 and 10, a rocker switch assembly 1 has an open top rectangular switch housing or case 2, that is preferably molded of a suitable insulating plastic material. A rectangular contact mounting block 3 having three spaced vertical grooves 4, 5, 6 at one end and similar grooves 7, 8, 9 at the other end slidably fits into the housing so that the grooves mate with vertical ribs 10, 11, 12 at each end of the switch case.

On top of the mounting block, as shown in FIG. 1, outside grooves 4 and 6 at the one end of block 3 intersect upward sloping channels 13 and 14, respectively, and central groove 8 at the other end of the block intersects a similar channel 15, the floor of each of these channels intersecting the top plane of the block at its center. Central groove 5 at the one end of the block, on the other hand, is separated from the outer end of a similar sloping channel 16 by a partition 17 that effectively extends groove 5 to almost the top plane of the block, while at the other end of the block grooves 7 and 9 extend all the way to the top surface.

On the bottom of the block, the six end grooves intersect the ends of separate flat pockets 18, each pocket having a triangular shape in longitudinal section, as shown in FIGS. 6–9. Thus, the end grooves, top channels, and bottom pockets combine to form three laterally spaced wraparound conductor channels for mounting three pairs of switch contact sets in insulated relation to each other.

The outer two contact sets are identical; each is a normally open set and comprises a first fixed contact member 19 and a first movable contact member 20. The center contact set is designed to be normally closed and comprises a second fixed contact member 21 and a second movable contact member 22. For simplicity of manufacture, the second fixed contact member 21 is identical to each first fixed contact member 19.

Each contact member is stamped from a strip of conductive spring metal, such as phosphor bronze. First and second fixed contact members 19, 21 have respective intermediate portions 23, 24 with a length approximately equal to the lengths of grooves 5, 7 and 9 in mounting block 3, respective short upper end portions 25, 26 bent at right angles to the intermediate portion and having dimpled contact areas 27, 28, and respective lower terminal portions 29, 30 bent to form an acute angle with the respective intermediate portions.

First and second movable contact members 20 and 22 have similar intermediate portions 31 and 32 and lower terminal portions 33 and 34, respectively, bent to an acute angle as with the fixed contact members. The upper ends of the first and second movable contact members 20 and 22 are bent at an obtuse angle with respect to the intermediate portions to form elongated cantilevered leaf spring portions 35 and 36 that terminate in first and second movable contacts 37 and 38, respectively.

The contact portions of the first and second movable contact members differ because of their respective normally open and normally closed functions, the end of the normally open first members 20 being flat and smoothly rounded and the end of the second member 22 being offset by a short downward step 39 to adapt it to fit underneath the upper end of the corresponding second fixed member when assembled in the switch.

From the foregoing description in conjunction with FIG. 1 it will be apparent that the switch contact sets can be easily mounted on block 3 merely by inserting the lower terminal portion in the appropriate bottom pocket and then wrapping the member around the end of the block until the intermediate portion fits snugly in the corresponding vertical groove, and the upper portion extends over the top of the block. The inwardly bent upper and lower portions of each contact member exert a slight clamping pressure against the adjacent block surfaces to hold the assembled contact sets in place without separate fasteners until the block can be slid into the switch case.

Preferably, the upper ends of the vertical ribs 10, 11, 12 are stepped, as shown in FIG. 1, or beveled to allow them to readily engage the respective grooves 4, 5, 6 and 7, 8, 9 as the mounting block is pressed to the bottom of the switch case. The block is locked in this bottom position by rounded ribs 40 molded on each inner side wall of the housing 2 at a level just above the top of the switch block when it is properly seated.

After the contact mounting block assembly has been securely locked in the switch housing, a molded plastic rocker button 41 is positioned in the opening of the switch case above the contact mounting block. Button 41 has a pair of axles or stub shafts 42 extending outward from each side, and these shafts slidably fit in mating vertical slots 43 extending downward on each side of the top opening of the housing.

Figure 11:
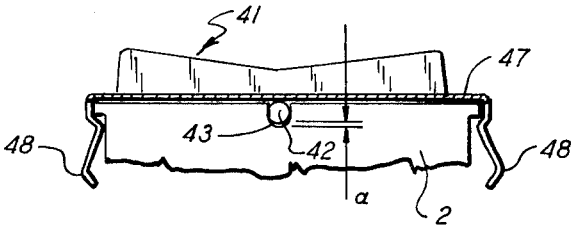
FIG. 11 is a partial side view of the switch assembly taken in the direction of arrows 11—11 of FIG. 5, with the side of the bezel frame cut away to show the vertical clearance between the stub shaft and the bottom of the mating half bearing slot.

As shown in FIG. 11, the bottom of each slot 43 is spaced below the top edge of the switch case by a clearance distance a more than the diameter of shaft 42 to provide a small amount of vertical pretravel when the switch button is actuated.

The rocker button also has an integrally molded lip or protuberance 44 extending outward from the end corresponding to the location of the normally closed contact pair 28, 38. This lip 44 is adapted to be engaged by a spring metal detent catch 45 mountable on the one end of the switch case. In its preferred form, catch 45 is an inverted U-shaped channel of spring metal that fits snugly over the upper edge of the switch case adjacent to the one end of the contact mounting block. Extending inward from the lower edge of the inverted U-channel are a pair of integral bent fingers 46 that provide a detent catch in cooperation with protuberance 44, as will be explained in more detail in connection with FIGS. 6–9.

Finally, after the contact mounting block (with its contact sets installed), the detent catch, and the rocker button all have been properly positioned in the switch case, the assembly is completed by snapping a metal bezel frame 47, having integral latching members 48 at each end, over end flanges 49 of the case.

Figure 6:
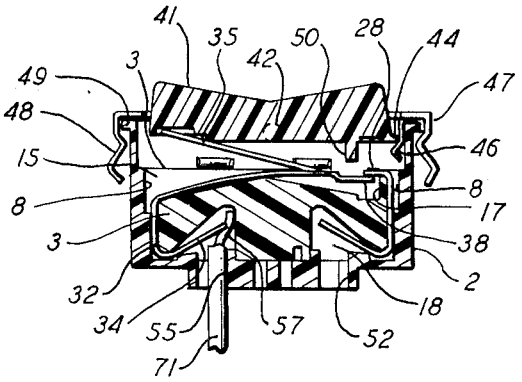
FIG. 6 is a section view in the direction of arrows 6—6 in FIG. 5, showing the normally closed pair of contacts with the rocker button in the intermediate horizontal or ON position.
Figure 7:
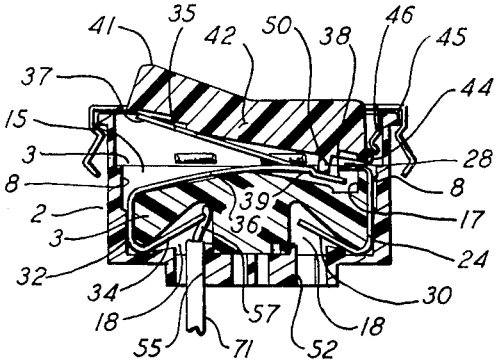
FIG. 7 is a section view in the same plane as FIG. 6 but with the rocker button in the tilted latched OFF position.
Figure 8:
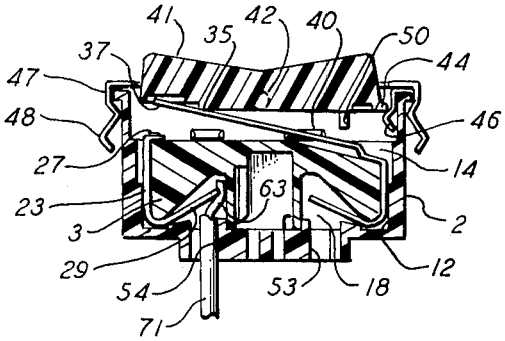
FIG. 8 is a section view in the direction of arrow 8—8 in FIG. 5, showing one pair of normally open contacts with the rocker button in the intermediate or ON position.

Referring next to FIGS. 6 through 9, the three operating positions of the rocker button are shown, with the corresponding relation between each contact pair. In FIGS. 6 and 8, the rocker button is in a horizontal or neutral position in which normally closed contacts 28, 38 (FIG. 6) are closed, and normally open contacts 27, 37 (FIG. 8) are open. In this neutral position the lower outside edge of protuberance 44 on the end of the rocker button is biased into contact with the upper surface of bent finger 46 of the spring metal detent catch by the upward force exerted by the ends of the leaf spring portions 35 of the first movable contact members of the normally open contacts against the under side of the other end of the rocker button.

In order to open the normally closed contacts, the one end of the rocker button is depressed until the protuberance 44 snaps past the knuckle of detent catch 46, as illustrated in FIG. 7. When this occurs, an integral pin 50 extending from the lower surface of rocker button 41 bears against the downward stepped portion 39 of the second movable switch member to push the movable contact 38 down and away from fixed contact 28. This position of the rocker button corresponds to the switch off condition and is a stable position because of the latching effect of the interference engagement between protuberance 44 and detent fingers 46.

Figure 9:
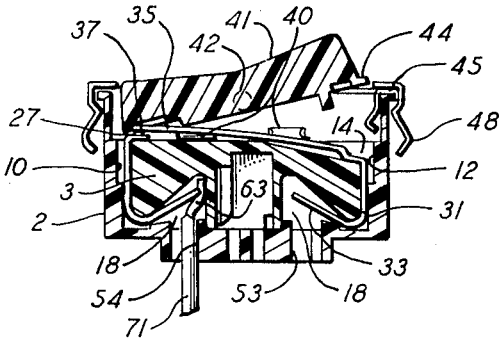
FIG. 9 is a section view in the plane of FIG. 8 but with the rocker button in the oppositely tilted momentary START position.
Figure 10:
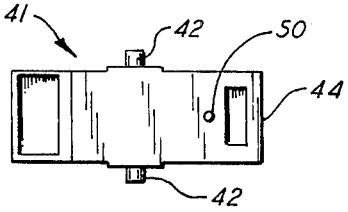
FIG. 10 is a bottom view of the rocker button.

On the other hand, to close the normally open contacts 27, 37, the other end of the rocker button must be tilted against the upward biasing force of leaf spring portions 35 of the first movable contact members, as shown in FIG. 9. Since there is no latching mechanism operative to hold the rocker button in this latter position, this is a momentary position, and the button returns to the neutral position of FIGS. 6 or 8 as soon as the tilting force is released.

Figure 4:
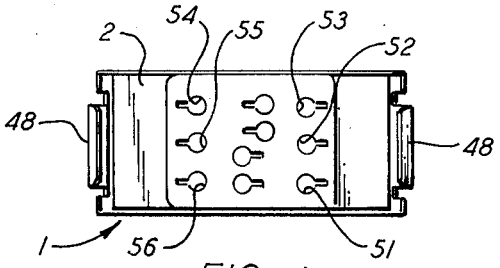
Figure 5:
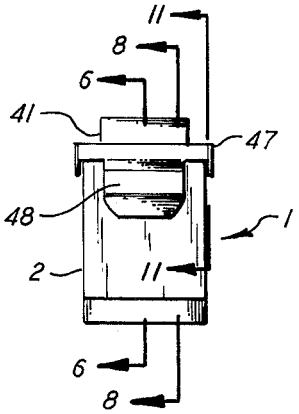
Figure 12:
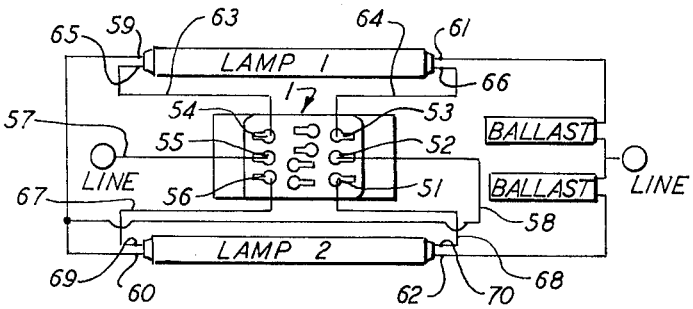
FIG. 12 is a schematic wiring diagram of a typical dual fluorescent lamp circuit.

To connect the switch embodiment of the drawings into a typical dual fluorescent lamp circuit of the type shown in FIG. 12, six holes 51, 52, 53, 54, 55 and 56 are provided in the bottom of the switch case in registry with the corresponding lower terminal ends of the two sets of first normally open contact members and the single set of normally closed contact members (see FIGS. 4 and 12). In the assembly arrangement depicted in the drawings, holes 51, 56 lead to the terminal ends of one pair of normally open contacts, holes 53, 54 lead to the terminal ends of the other pair of normally open contacts, and holes 52, 55 lead to the pair of normally closed contacts.

In FIG. 12, a wire 57 leads from terminal hole 55 to one side of the line, and a wire 58 leads from terminal hole 52 to terminal pins 59, 60 at one end of each of a pair of fluorescent lamps. Terminal pins 61, 62 at the other end of each respective lamp are connected to the other side of the line through suitable ballasts. Thus, the lamps are connected across the line at all times when the rocker button is in the neutral or on position (normally closed contacts are closed) and are disconnected from the line when the rocker button is tilted to the stable off position (normally closed contacts are open). Wires 63 and 64 lead from terminal holes 54 and 53 to the remaining pins 65 and 66, respectively, of the first lamp, and wires 67 and 68 lead from terminal holes 56 and 51 to the remaining pins 69 and 70, respectively, of the second lamp.

Each lamp has a conventional resistance heater connected between the terminals at each end for ionizing the gas to facilitate starting the lamp. Thus, the illustrated circuit arrangement connects the two heaters of the first lamp in series across the line through one of the normally open contact sets and similarly connects the heaters of the second lamp across the line through the other of the normally open contact sets. Consequently, when the rocker button is tilted to the momentary start position, thereby closing these two sets of contacts, the heaters are energized to enable the lamps to turn on.

In making the physical connection of wires to the switch, for each terminal hole 51–56 an insulated wire of proper size is prepared by stripping back the insulation 71 (FIGS. 6–9) an appropriate distance, and the bare end of the wire is inserted into the hole past the terminal end of the corresponding contact member so that the wire becomes wedged between the end of the contact and the side of the pocket. The terminal end preferably is slightly folded about its centerline and the tip notched, as shown in FIG. 1, to give a better bite into the wire. This construction allows rapid wiring under assembly line conditions yet provides a terminal connection that meets requisite electrical standards, with a minimum force of more than five pounds required to pull the wire free after the connection has been made.

Thus, the preferred embodiment of the present invention provides a two-stage rocker button switch of simple yet sturdy design. The two-lamp control switch has a total of only eleven parts, whereas the two-button design described above required approximately twice that number.

It will be apparent that the above switch design can be modified easily to control any reasonable number of lamps by providing a pair of normally open contacts for each lamp, so long as the normally closed set of contacts is capable of carrying and interrupting the total lamp current. In particular, one set of the normally open contacts could be eliminated if only one lamp were to be controlled. Furthermore, the basic design of the invention is adapted for use as a single pole, on-off switch by providing only one set of normally closed contacts.

Most importantly, the improved design of the present invention results in smooth, positive, and repeatable on-off action in a switch that requires a minimum number of parts and greatly reduced labor for assembly.

I claim:

1. A rocker switch assembly comprising:

an open top housing;

a core fitted within the housing for mounting at least one pair of switch contacts;

a pair of normally closed switch contacts located near one end of the core, said pair of normally closed contacts including a fixed contact positioned in vertically spaced relation to the top surface at the one end of the core, a movable contact positioned between the fixed contact and the top surface of the core, and spring biasing means for urging the movable contact upward toward the fixed contact;

a rocker button positioned in the opening of the housing above the core, the rocker button having a protuberance extending from the end of the button corresponding to the one end of the core;

a metal spring catch mounted in the housing for interfering engagement with the protuberance on the rocker button; and means for supporting the rocker button for limited vertical and pivotal motion about a transverse axis at approximately its midpoint, said means restraining the button against movement in a direction parallel to the top of the housing transverse to the pivot axis, the rocker button acting to depress the movable contact in opposition to the spring biasing means out of conductive contact with the fixed contact when pivoted toward the one end of the core as the protuberance engages the spring catch, the catch bearing against the upper side of the protuberance to hold open the pair of contacts against the force exerted by the biasing means.

2. The rocker switch assembly of claim 1 wherein the means for pivotally supporting the rocker arm comprises an axle extending from each side of the rocker button and a mating vertical slot extending downward on each side of the top opening of the housing.

3. The rocker switch assembly of claim 2 further comprising a bezel frame mounted on top of the switch housing and surrounding the rocker button to hold the axles in the mating vertical slots.

4. The rocker switch assembly of claim 3 wherein the depth of each vertical slot is greater than the diameter of the corresponding axle to permit a predetermined amount of downward motion of the axles in the slots against the upward forces of the biasing means when downward force is exerted on the rocker button.

5. The rocker switch assembly of claim 1 wherein the metal spring catch comprises a U-channel portion that fits over the edge of the housing and a bent finger portion extending from the inner wall of the channel portion for interfering engagement with the protuberance extending from the end of the rocker button.

6. The rocker switch assembly of claim 1 further comprising:

at least one pair of normally open switch contacts located near the other end of the core, each pair of normally open contacts including a fixed contact on top of the core, a movable contact positioned above the fixed contact, and spring biasing means for urging the movable contact upward away from the fixed contact, the rocker button acting to depress each movable contact in opposition to the biasing means into conductive contact with the corresponding fixed contact of the normally open contact pairs when the button is pivoted toward the other end of the core.

7. The rocker switch assembly of claim 6 wherein the spring biasing means of the normally closed and normally open contact pairs comprise leaf springs cantilevered respectively from the other and the one ends of the core, the movable contacts of the normally open pairs being located on the free end of the leaf spring cantilevered from the one end, and the movable contact of the normally closed pair being located on the free end of the leaf spring cantilevered from the other end.

8. The rocker switch assembly of claim 7 wherein the top of the core is formed with parallel spaced channels extending downwardly from the middle of the core to the one and the other ends, the leaf spring of the normally open pairs being positioned in the channels extending downwardly to the one end, and the leaf spring of the normally closed pair being positioned in the channel extending downwardly to the other end.

9. The rocker switch assembly of claim 8 wherein the ends of the core are formed with parallel spaced vertical grooves, the ends of the housing are formed with vertical ribs spaced to slidably fit within the corresponding grooves, and the fixed ends of the cantilevered leaf springs are held between the grooves and the ribs.

10. The rocker switch assembly of claim 7 wherein the bottom of the core is formed with parallel laterally spaced pockets, and the fixed ends of the cantilevered leaf springs are bent inwardly and extend upwardly into corresponding pockets in the bottomm of the core to serve as wedge-type push wiring terminals.

* * * * *